US007731531B2

(12) United States Patent
Tsujino

(10) Patent No.: US 7,731,531 B2
(45) Date of Patent: Jun. 8, 2010

(54) POWER CORD

(75) Inventor: Shinichi Tsujino, Osaka (JP)

(73) Assignee: Fuji Electric Wire Industries Co., Ltd., Osaka (JP)

( * ) Notice: Subject to any disclaimer, the term of this patent is extended or adjusted under 35 U.S.C. 154(b) by 540 days.

(21) Appl. No.: 11/530,102

(22) Filed: Sep. 8, 2006

(65) Prior Publication Data

US 2008/0009200 A1 Jan. 10, 2008

(30) Foreign Application Priority Data

Jul. 5, 2006 (JP) ..... 2006-185909

(51) Int. Cl.
*H01R 13/58* (2006.01)

(52) U.S. Cl. ..... 439/606; 439/736; 29/858

(58) Field of Classification Search ..... 439/606, 439/655, 718, 736, 83, 604, 858, 883; 29/856, 29/857, 858, 869, 883
See application file for complete search history.

(56) References Cited

U.S. PATENT DOCUMENTS 3,093,434 A * 6/1963 Francis ..... 439/695
4,718,865 A * 1/1988 Cordeiro ..... 439/606
5,749,656 A * 5/1998 Boehm et al. ..... 374/185
6,761,551 B2 * 7/2004 Kondo ..... 425/116
7,070,460 B1 7/2006 Nagano
7,187,829 B2 * 3/2007 Anderson et al. ..... 385/100

FOREIGN PATENT DOCUMENTS

JP 2003-178835 6/2003

* cited by examiner

*Primary Examiner*—Xuong M Chung-Trans
(74) *Attorney, Agent, or Firm*—Greenblum & Bernstein, P.L.C.

(57) ABSTRACT

A power cord which prevents breakage of a plug or cord/conductors even when treated roughly, and thus has a longer life. The power cord includes a plurality of cores of a synthetic resin, each for covering a connection section of a single blade among a plurality of blades, and an outer skin of a synthetic resin, for covering the plurality of cores together such that the blades are held at a specified interval spacing so as to form a plug. The synthetic resin forming the outer skin is softer than the synthetic resin forming the cores. The outer skin includes a thicker part for covering a border part of each cord having an internal covering member between a part covered with the core and a part exposed from the core.

13 Claims, 5 Drawing Sheets

POWER CORD

BACKGROUND OF THE INVENTION

1. Field of the Invention

The present invention relates to a power cord including a plug at a leading end thereof.

2. Description of the Prior Art

One type of conventional power cord includes a plug as described below. Conductors projected (exposed) from leading ends of a plurality of cords are connected to blades. The plug includes an outer skin for covering trailing ends of the blades and the leading ends of the cords. The outer skin is formed of a synthetic resin.

Such a plug has a structure described in, for example, Japanese Laid-Open Patent Publication No. 2003-178835. The plug includes an internal molded body (core), formed of a hard resin, including a plurality of covering and fixing sections. Each covering and fixing section covers a connection part at which the trailing end of each blade is connected to the conductors exposed from the leading end of each cord. The plug also includes an external molded body (outer skin), formed of a soft resin, for covering the covering and fixing sections of the core together.

Such a plug includes the core formed of a soft resin and the outer skin formed of a hard resin. Owing to such a structure, even when a user treats the plug roughly, for example, swings the plug strongly in a direction in which the blades are arranged, the connection parts of the trailing ends of the blades and the conductors are prevented from being broken. Thus, the blades can be displaced with a higher degree of freedom with certainty. In other words, the life of the power cord can be extended by providing the core and the outer skin in the plug.

In the power cord disclosed in the above-identified patent document, the core has a bridge for connecting the covering and fixing sections each for covering the connection part. According to the above-identified patent document, the plug has the following advantages. Even when a strong tensile force or bending stress is applied to the blade/cord connection parts, the bridge alleviates such a force. In addition, the stress applied to the covering and fixing sections by, for example, the bridge being bent is alleviated by the outer skin. As a result, the bending stress applied to the connection parts is reduced. Even when the plug is treated roughly, there is no possibility of breakage of the connection parts.

However, a power cord is occasionally treated more roughly than the plug being swung in the above-mentioned direction. For example, when the user carries an electric appliance including the power cord, the user may hang the power cord on his/her shoulder while holding the plug in his/her hand. In such a case, the blade/cord connection parts are subjected to a stronger tensile force or bending stress than in the case where the plug is swung in the above-mentioned direction.

In the case of a plug as described in the above-identified patent document including a core having a bridge, the applied tensile force or bending stress may exceed the bending limit of the bridge. As a result, the bridge may be broken.

The plug described in the above-identified patent document also has the following drawback. A border part of each cord between a part covered with the covering and fixing section of the core and a part exposed therefrom is not sufficiently reinforced. When the plug is treated excessively roughly, for example, when the user holds the plug in his/her hand while hanging the power cord on his/her shoulder to carry the electric appliance including the power cord as described above, the bending stress is concentrated on the border part due to a significant hardness difference between the core and the cord. This also results in breakage of the cord or conductors.

The present invention has an object of providing a power cord for preventing breakage of a plug or cord/conductors or conductors with certainty even when being treated roughly and thus having a longer life.

SUMMARY OF THE INVENTION

A power cord according to the present invention comprises: a plurality of blades each including an outlet insertion part at a leading end thereof and a connection section at a trailing end thereof, the connection section being connected to a plurality of conductors exposed from a leading end of a corresponding cord among a plurality of cords; a plurality of cores each for covering the connection section of a single corresponding blade of the plurality of blades, the cores being formed of a synthetic resin; and an outer skin for covering the plurality of cores together such that the plurality of blades are held at a specified interval spacing, so as to form a plug, the outer skin being formed of a synthetic resin. The synthetic resin forming the outer skin is softer than the synthetic resin forming the cores; and the outer skin includes a thicker part for covering a border part of each cord between a part covered with the core and a part exposed from the core.

In the present invention, the term "leading end" refers to an end of various elements of a power cord closer to the tips (outlet insertion parts) of the blades, and the term "trailing end" refers to the opposite end of the various elements of the power cord.

In one embodiment of the invention, the cores hold leading ends of the cords as directed to be separated from each other, and hold the blades so as to be parallel to each other.

In one embodiment of the invention, the cores each include a trailing end part and a leading end part, and the trailing end parts of the cores are angled relative to each other as directed to be separated from each other whereas the leading end parts of the cores are parallel to each other.

In one embodiment of the invention, trailing end surfaces of the cores are aligned to the same plane as each other; and the thicker part of the outer skin is aligned to the same plane as the trailing end surfaces of the cores.

In one embodiment of the invention, the outer skin includes a constricted part at a position closer to a leading end of the outer skin than the thicker part, the constricted part being thinner than the thicker part and covering an outer circumferential surface of the cores.

In one embodiment of the invention, the constricted part is formed to be recessed from the thicker part in a curve in the shape of a portion of a circle or an ellipse.

In one embodiment of the invention, the outer skin includes a tapering part at a position closer to a trailing end of the outer skin than the thicker part, the tapering part continuously extending from the thicker part and becoming gradually thinner.

In one embodiment of the invention, the blades each have a wider part in a trailing end part thereof which is wider than a leading end part thereof.

In one embodiment of the invention, the wider part has a continuous flat surface.

In one embodiment of the invention, the connection section includes a crimping section and a joint section; the crimping section pressure-contacts the conductors to the trailing end of the blade; and the joint section joints the conductors to the wider part by welding.

In one embodiment of the invention, the cores each have a thicker part, which is thicker than the remaining part thereof, for covering the wider part of the blade.

In one embodiment of the invention, a single cord among the plurality of cords is provided for each blade; and the plurality of cords are covered together with a common external covering member in the state where a buffering member is interposed between plurality of cords and the common external covering member.

In one embodiment of the invention, the synthetic resin forming the cores is 66 nylon, and the synthetic resin forming the outer skin is polyvinyl chloride.

According to the present invention, a plurality of cores are provided such that one core is usable for one blade. Therefore, even when a strong tensile force, bending stress or the like is applied by the rough treatment, the connection parts are prevented from being broken owing to the cores and the outer skin, and the cores are prevented from being broken owing to the outer skin.

Since the outer skin includes a thicker part, the outer skin can be recovered to the original shape with certainty when the plug is released from the strong tensile force, bending stress or the like after being subjected thereto.

Since the thicker part is formed to cover the border parts, the cords or conductors can be prevented from broken at the border parts with certainty even when the plug is subjected to a strong tensile force, bending stress or the like.

Accordingly, owing to the plurality of cores and the thicker part of the outer skin, the power cord according to the present invention guarantees protection of the internal components of the plug against a strong tensile force, bending stress or the like even when the power cord is treated excessively roughly. As a result, the life of the power cord can be extended.

DESCRIPTION OF THE PREFERRED EMBODIMENTS

Hereinafter, an embodiment of the present invention will be described in detail with reference to the figures.

Figure 1:
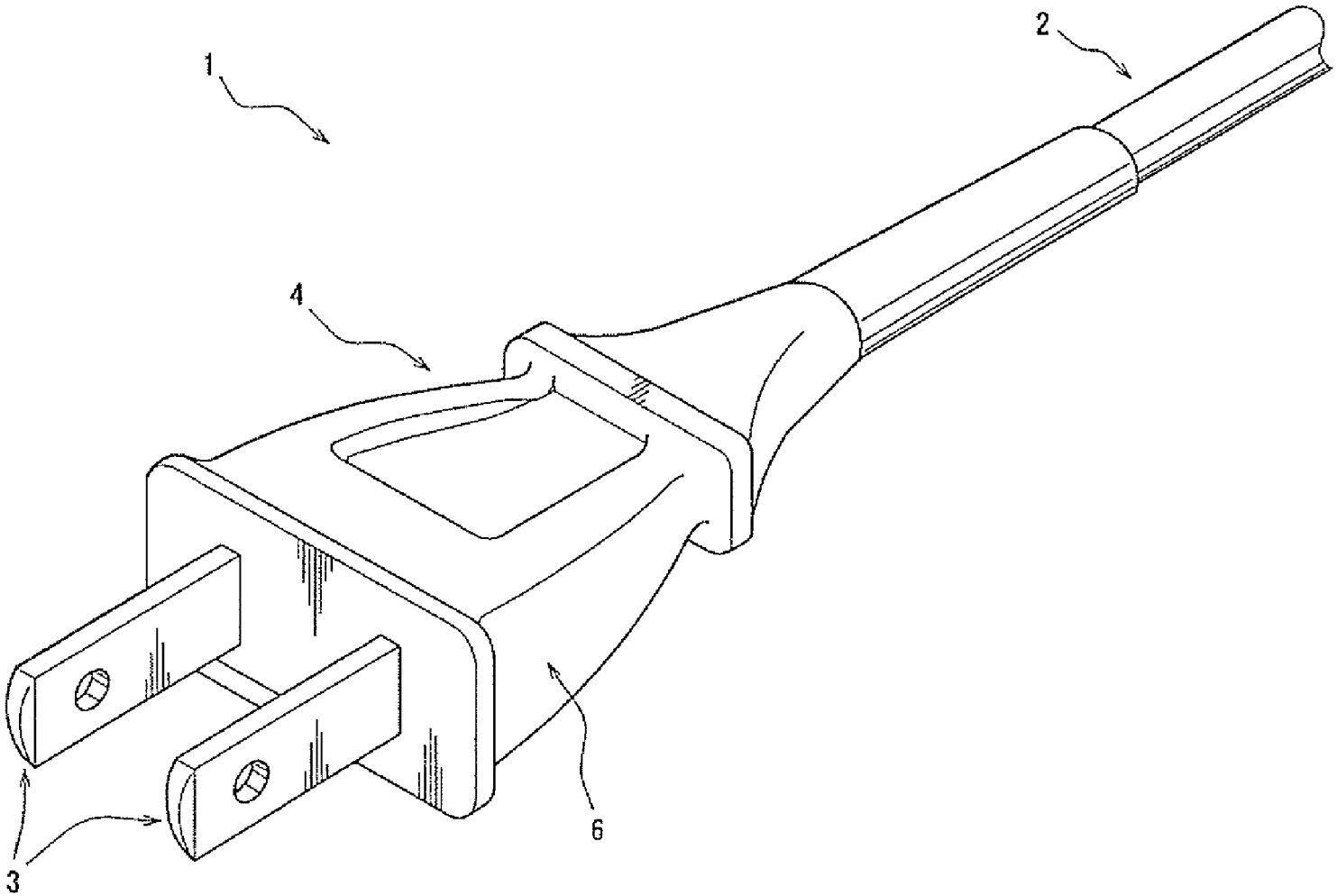
FIG. 1 is a perspective view of a power cord according to an embodiment of the present invention.
Figure 2:
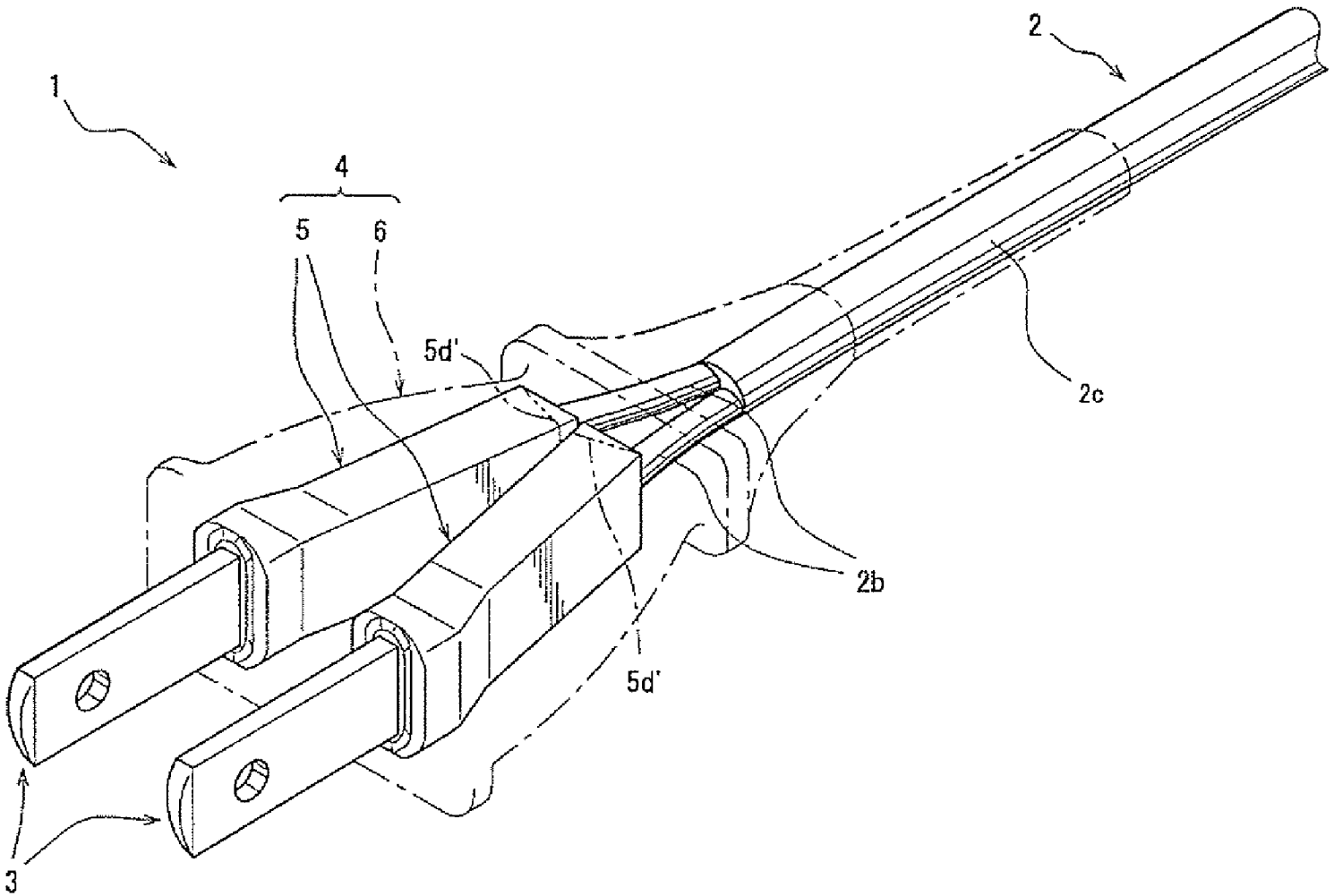
FIG. 2 is a perspective view of an important part of the power cord.

As shown in FIG. 1 and FIG. 2, a power cord 1 includes a plug 4, and blades 3 connected to a leading end of a cord 2. A leading end (outlet insertion part) of each blade 3 is projected from the plug 4. The plug 4 is formed by two molding steps, i.e., a molding step for forming cores 5 and a molding step for forming an outer skin 6 (both shown in FIG. 2). In this embodiment, the power cord 1 is described as including two blades 3, but the present invention is also applicable to, for example, a power cord of a type usable for a three-phase alternating current power source.

Figure 3:
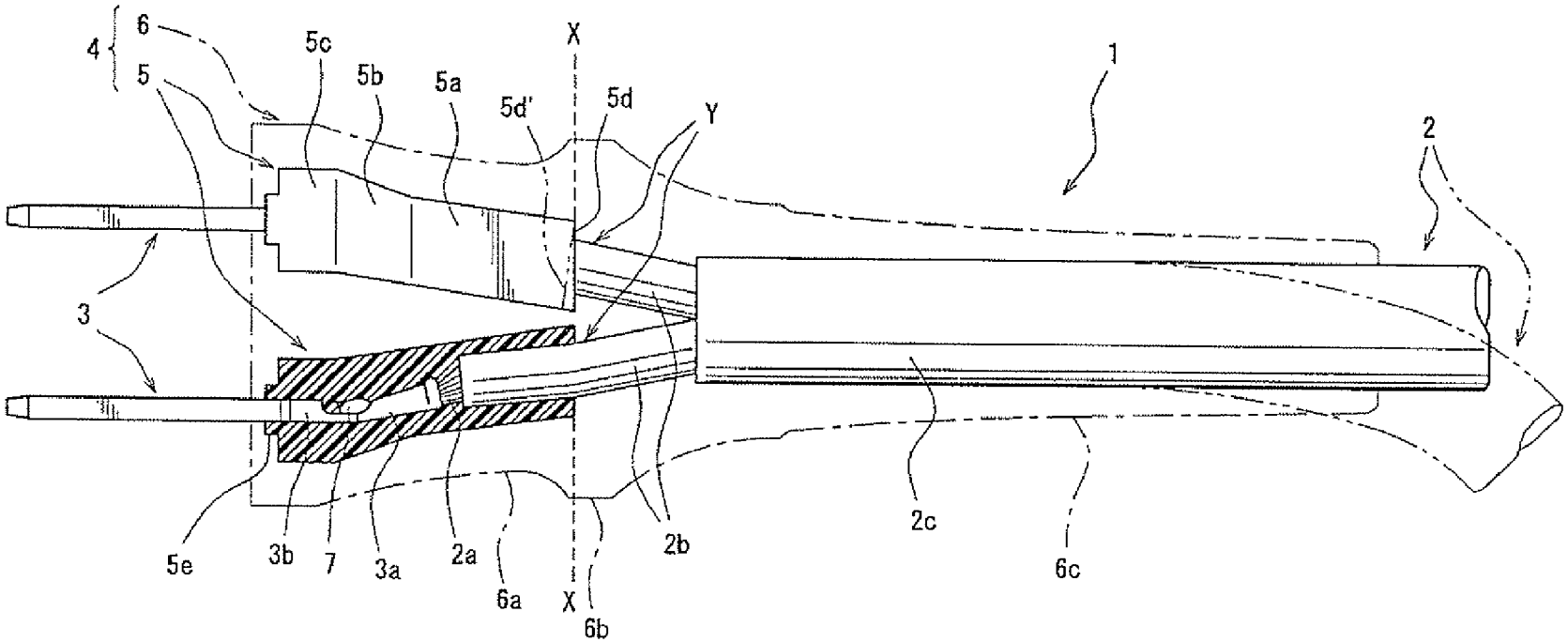
FIG. 3 is a cross-sectional view of the power cord taken along one direction.
Figure 4:
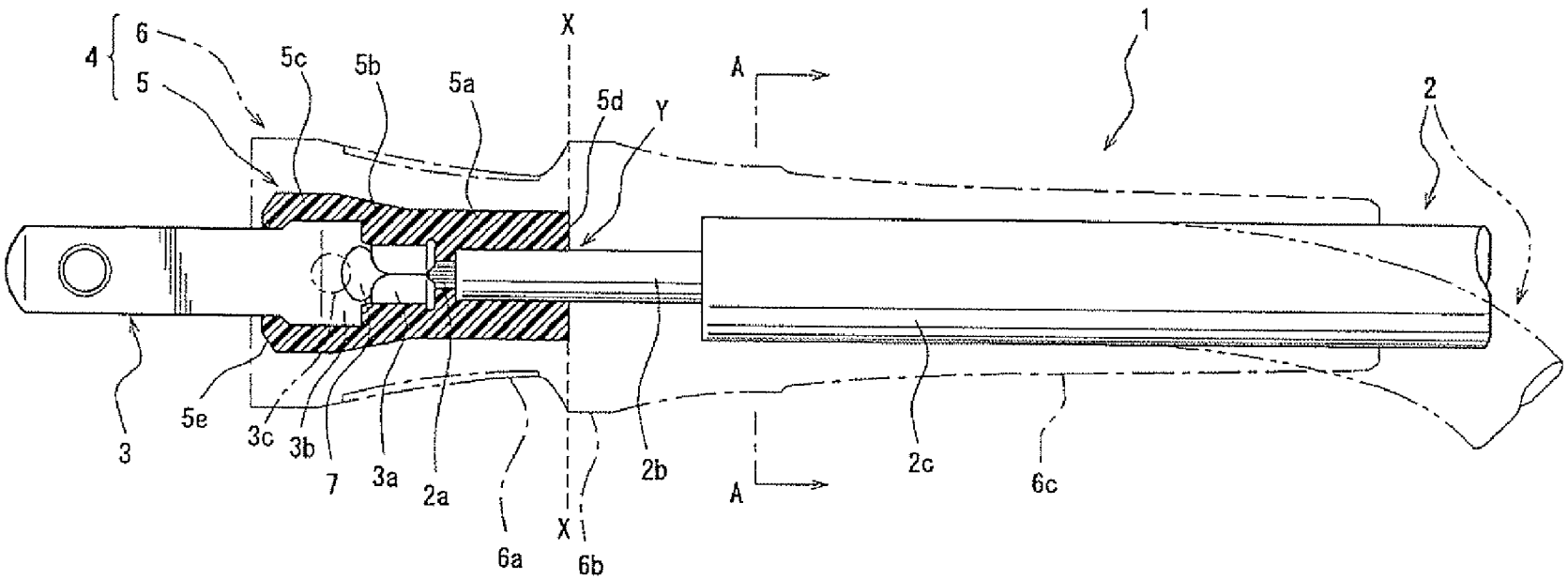
FIG. 4 is cross-sectional view of the power cord taken along another direction generally perpendicular to the direction in FIG. 3.
Figure 5:
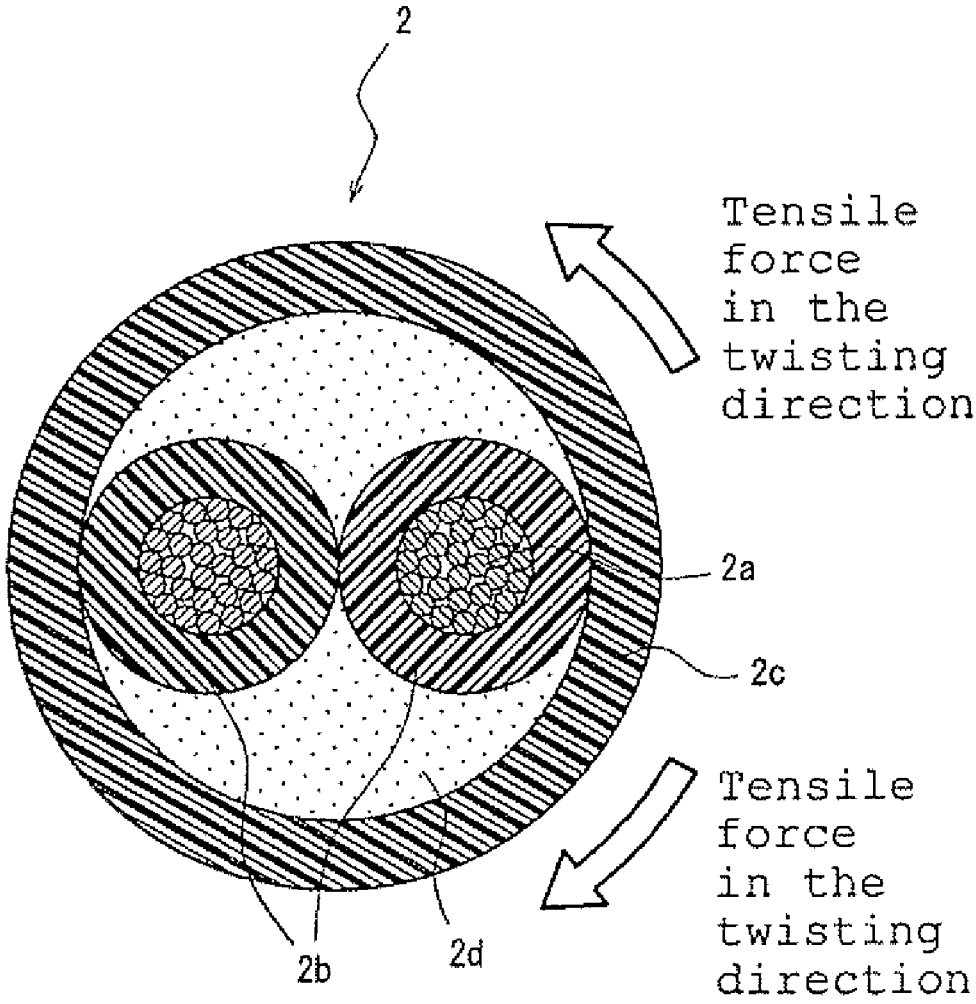
FIG. 5 is a cross-sectional view of the power cord taken along line A-A in FIG. 4.

As shown in FIG. 3 through FIG. 5, the cord 2 includes conductors 2*a*, internal covering members 2*b* each for covering an outer surface of a bundle of the conductors 2*a*, and an external covering member 2*c* for covering the internal covering members 2*b* together. The internal covering members 2*b* and the external covering member 2*c* are formed of, for example, a rubber material such as chloroprene rubber, EP rubber, chlorosulphonated polyethylene rubber or the like, or an appropriate vinyl material. One internal covering members 2*b* covers the conductors 2*a* connected to one blade 3, and the other internal covering members 2*b* covers the conductors 2*a* connected to the other blade 3. The external covering member 5*c* covers outer circumferential surfaces of both the internal covering members 2*b*.

A leading end part of the cord 2 has a structure as shown in FIG. 3 and FIG. 4. The internal covering members 2*b* are extended out of the external covering member 2*c*, so as to be separated from each other by a greater distance as approaching leading ends thereof. At the leading end of each internal covering member 2*b*, the conductors 2*a* are exposed. The conductors 2*a* are pressure-contacted by crimping to, and thus connected to, a base 3*a* of each blade 3 at a trailing end thereof.

The blades 3 each have a wider part 3*b*, which is wider than the outlet insertion part, adjacent to the base 3*a* toward a leading end thereof. The width of the blade 3 becomes smaller at a position between the wider part 3*b* and the outlet insertion part.

The conductors 2*a* are spot-welded to the wider part 3*b*. The conductors 2*a* are connected to the blade 3 via a nugget 7 formed by the spot welding, in addition to being connected by the crimping. As described above, the blade 3 and the conductors 2*a* (cord 2) are connected to each other via the base 3*a* and the nugget 7 in a trailing end part of the blade 3.

The trailing end part of one blade 3 and the leading end of the internal covering member 2*b* (cord 2) connected thereto, and the trailing end part of the other blade 3 and the leading end of the internal covering member 2*b* (cord 2) connected thereto, are insert-molded in the cores 5 in the state of being positioned at a specified interval spacing. A plurality of cores 5 are provided such that one core 5 is usable for one blade 3. The plurality of cores 5 are independent from one another. After the insert molding, the cores 5 respectively integrated with blades 3 are insert-molded in the outer skin 6 represented by the one-dot chain line so as to realize the state shown in FIG. 3. Thus, the plug 4 is formed.

The cores 5 each having the trailing end part of the blade 3 and the leading end of the internal covering member 2*b* inserted therein are specifically formed as follows. In the state where leading ends of the conductors 2*a* are connected to the bases 3*a* of the blades 3, the leading ends of the internal covering members 2*b* are held at an angle relative to each other and thus directed so as to be separated as described above, whereas the blades 3 are held parallel to each other. The blades 3/the internal covering members 2*b* are positioned at such a specified interval spacing in a molding die. Then, injection molding is performed using a synthetic resin. Thus, the cores 5 are formed. The resultant cores 5 hold the internal covering members 2*b* as directed so as to be separated from each other and hold the blades 3 parallel to each other. As the synthetic resin for forming the cores 5, 66 nylon, which is a hard thermoplastic resin, is used.

The cores 5 each include an inclining part 5*a* at a trailing end part thereof. The inclining parts 5*a* extend at an angle relative to each other and thus directed so as to be separated from each other. Each core 5 includes a middle part 5*b* having a gradually increasing thickness from the base 3*a* of the blade 3. Each core 5 also includes a parallel part 5*c* which extends parallel to the other parallel part 5*c* from the nugget 7 where the blade 3 are connected to the conductors 2*a*. The parallel part 5*c* is thickest of the core 5. In this manner, the cores 5 extend in compliance with the internal covering members 2*b* and the blades 3 which extend in sequentially changing directions secured by the insert molding.

The cores 5 formed of a hard resin may be, for example, parallelepiped in order to be increased in thickness. However, the cores 5 having a shape matching the shape of the internal covering members 2*b* and the blades 3 as in this embodiment allow the blades 3 and the cord 2 to be protected by a minimum necessary thickness while guaranteeing a necessary thickness of the outer skin 6 formed of a soft material. Therefore, the outer skin 6 can be protected from being broken against a strong tensile force or bending stress.

Trailing end surfaces 5*d* of the cores 5 extend in a direction perpendicular to a longitudinal direction of the power cord 1, and are aligned to the same plane X represented by the dashed line in FIG. 3 and FIG. 4.

Each core 5 further includes a projecting part Se at a leading end thereof projecting from the center of the parallel part 5*c* toward the leading end of the blade 3. The outlet insertion part is exposed from the projecting part 5*e*.

The outer skin 6 is formed as follows. The cores 5, each integrated with the corresponding set of the internal covering member 2*b* and the blade 3 as a result of the insert molding, are put into a molding die having a specified shape. Then, injection molding is performed using a synthetic resin. Thus, the outer skin 6 is formed. As a result, the plug 4 including the plurality of cores 5 and the outer skin 6 for covering the plurality of cores 5 together is completed. As a synthetic resin for forming the outer skin 6, polyvinyl chloride, which is a thermoplastic resin softer than the synthetic resin used for the cores 5, is used.

As described above, the internal covering members 2*b* are held as directed to be separated from each other and the blades 3 are held parallel to each other by the cores 5. Therefore, the blades 3 are prevented from being directed outward owing to the rigidity of the internal covering members 2*b*, and do not need to be forcibly directed parallel to each other when forming the outer skin 6. In this way, the cores 5 can improve the molding operability of the outer skin 6, and generation of defective products including the blades 3 extending in a wrong direction can be prevented.

Unlike the power cord disclosed in Japanese Laid-Open Patent Publication No. 2003-178835 having covering and fixing sections connected to each other via a bridge, the power cord 1 in this embodiment includes the cores 5 such that one core 5 is provided for one blade 3. This is facilitates the fine adjustment of the distance between the blades 3 when forming the outer skin 6.

The outer skin 6 formed by the above-described injection molding includes a constricted part Ga. The outer skin 6 gradually becomes thinner from a leading end thereof toward the constricted part Ga. The outer skin 6 also includes a thicker part 6*b* adjacent to the constricted part 6*a* toward a trailing end thereof. The thicker part 6*b* is largely projected outward, has a greater thickness than the remaining part, and is continuous from the constricted part 6*a*. The outer skin 6 further includes a tapering part 6*c* adjacent to the thicker part 6*b* toward the trailing end thereof. The tapering part 6*c* is continued from the thicker part 6*b* while gradually becoming thinner toward the trailing end thereof. The tapering part 6*c* extends up to a position far from a leading end of the external covering member 2*c* in the longitudinal direction of the power cord 1.

The constricted part 6*a* covers the outer circumferential surfaces of the cores 5. The thicker part 6*b* covers the border parts Y of the internal covering members 2*b* between the parts covered with the cores 5 and the parts exposed therefrom.

A part of the outer skin 6 between the constricted part 6*a* and the thicker part 6*b* is formed to be recessed in a curve in the shape of a portion of a circle or an ellipse as shown in FIG. 3 and FIG. 4. With such a shape, the user can easily position his/her fingers on the plug 4 when pulling the plug 4 from the outlet (not shown).

When the user carries an electric appliance including the power cord 1, for example, with the cord 2 being hung on his/her shoulder while the plug 4 being held in his/her hand, or treats the power cord 1 excessively roughly in any other way, a strong tensile force, or bending stress or the like is applied to the plug 4. In the case of a plug as disclosed in Japanese Laid-Open Patent Publication No. 2003-178835 including a core having a bridge, the tensile force or bending stress may exceed the bending limit of the bridge, resulting in breakage of the bridge.

In this embodiment, the same number of cores 5 are provided as that of the blades 3. Therefore, the cores 5 are not restricted by each other, and the blades 3 can be individually displaced with a high degree of freedom in the outer skin 6. Therefore, even when a strong tensile force, bending stress or the like is applied by the rough treatment as described above, the connection parts of the conductors 2*a* and the blades 3 are prevented from being broken owing to the cores 5 and the outer skin 6, and the cores 5 are prevented from being broken owing to the outer skin 6.

The outer skin 6 includes the thicker part 6*b*. Owing to this, the outer skin 6 can be recovered to the original shape with certainty when the plug 4 is released from the strong tensile force, bending stress or the like after being subjected thereto. The thicker part 6*b* is formed to cover the border parts Y, which prevents the plug 4 from being bent at the border parts Y when the plug 4 is subjected to the strong tensile force, bending stress or the like. In other words, a part of the plug 4 which has a large hardness difference due to the cores 5 and the internal covering members 2*b* can be protected with certainty, and thus the conductors 2*a* and the internal covering members 2*b* (cord 2) are prevented from being broken at the border parts Y with certainty.

As described above, the provision of the plurality of cores 5 and the thicker part 6*b* of the outer skin 6 guarantees protection of the internal components of the plug 4 against a strong tensile force, bending stress or the like even when the power cord 1 is treated excessively roughly. As a result, the life of the power cord 1 can be extended.

The outer skin 6 includes the constricted part 6*a* for covering the cores 5. Owing to this, the position at which the power cord 1 is bent can be displaced to the part where the blades 3 and the internal covering members 2*b* are covered with the cores 5. This prevents the internal covering members 2*b* from being broken with a higher degree of certainty.

The outer skin 6 includes the tapering part 6*c* in a trailing end part thereof, which extends to a position sufficiently far from the connection part of the conductors 2*a* and the blades 3. Owing to this, the position at which the power cord 1 is bent can be displaced toward the trailing end as represented by the two-dot chain line in FIG. 3 and FIG. 4. Therefore, the influence of the bending stress or the like on the parts Y can be alleviated.

The trailing end surfaces 5*d* of the cores 5 are aligned to the same plane X. This allows the position of the thicker part 6*b* and the position of the trailing end surfaces 5*d* to be precisely matched to each other in the longitudinal direction of the power cord 1. Thus, the border parts Y can be protected with certainty. For example, in the case where the trailing end surfaces 5*d* are formed to be angled with respect to each other as represented by the two-dot chain line (trailing end surfaces 5d') in FIG. 2 and FIG. 3, the internal covering members 2b are exposed from the trailing end surfaces 5d' of the cores 5 at different positions on the inner side and the outer side of the core 5. In this case, the thicker part 6b needs to have a complicated shape.

In this embodiment, 66 nylon is used as the synthetic resin for forming the cores 5, and polyvinyl chloride is used as the synthetic resin for forming the outer skin 6. The synthetic resins are not limited to these materials. Any combination of synthetic resins such that the outer skin 6 and the cores 5 have a hardness difference and the outer skin 6 is softer than the cores 5 is usable.

The blades 3 are reinforced in the trailing end parts thereof against a strong tensile force or bending stress by providing the wider parts 3b. In addition, both of side edges of each blade 3 are stepped because of the wider part 3b. Owing to this, the wider part 3b is usable as a locking part for preventing the blade 3 from being pulled off from the core 5. Conventionally, a hole 3c represented by the two-dot chain line in FIG. 4 is formed at a generally central position of the trailing end part of the blade 3, and a locking part is formed while the core 5 is molded. In this case, there is a problem that the strength of the trailing end part of the blade 3 is lowered due to the hole 3c.

By contrast, this embodiment realizes the locking function by the wider part 3b. There is no need to form the hole 3c, and the blade 3 can have a continuous flat surface. This maintains the strength of the connection part of the blade 3 and the internal covering member 2b. The wider part 3b also provides a sufficient space for spot welding.

If the conductors 2a are pressure-contacted by crimping to the base 3a too strongly, the durability of the conductors 2a may be lowered against the tensile force, bending stress or the like in a part exposed from the trailing end of the base 3a. In this embodiment, the conductors 2a are connected to the blade 3 via the nugget 7 as well as being connected to the base 3a by crimping. Therefore, the crimping force for pressure-contacting the conductors 2a to the base 3a can be set to be relatively weak. Thus, the conductors 2a can be prevented from being broken due to the crimping.

Since the nugget 7 electrically connects the conductors 2a and the blade 3 with certainty, the electric characteristics of the power cord 1 can be stabilized.

The outer circumferential surface of the connection part of the blade 3 and the conductors 2a is covered with the middle part 5b and the parallel part 5c of the core 5, and thus is certainty protected against the tensile force, bending stress or the like.

As shown in FIG. 5, the cord 2 has a multi-layer structure including a buffering member 2d formed of a fiber material or the like sandwiched between the internal covering members 2b respectively provided for the blades 3 and the common external covering member 2c. Owing to such a structure, even when a tensile force is generated in a twisting direction as represented by the arrows in FIG. 5, each bundle of conductors 2a covered with the corresponding internal covering member 2b can be displaced with a certain degree of freedom without being restricted by the other bundle of conductors 2a. Therefore, the conductors 2a are protected against an excessive tensile force.

The elements of the present invention and the elements in the above-described embodiment correspond to each other as follows.

The crimping section of the present invention corresponds to the base 3a in the embodiment;

the joint section corresponds to the nugget 7;

the thicker part of the core corresponds to the parallel part 5c; and the common covering member corresponds to the outer covering member 2c.

However, the present invention is not limited to the above-described embodiment and can be provided in various other embodiments.

The invention claimed is:

1. A power cord, comprising:

a plurality of blades each including an outlet insertion part at a leading end thereof and a connection section at a trailing end thereof, the connection section being connected to a plurality of conductors exposed from a leading end of a corresponding cord among a plurality of cords;

a plurality of cores each for covering the connection section of a single corresponding blade of the plurality of blades, the cores being formed of a synthetic resin; and an outer skin for covering the plurality of cores together such that the plurality of blades are held at a specified interval spacing, so as to form a plug, the outer skin being formed of a synthetic resin;

wherein:

the synthetic resin forming the outer skin is softer than the synthetic resin forming the cores;

the outer skin includes a thicker part for covering a border part of each cord between a part covered with the core and a part exposed from the core;

a separate core of the plurality of cores is provided for each blade of the plurality of blades;

the plurality of cores are completely covered by the outer skin;

trailing end surfaces of the cores are aligned to the same plane as each other; and the thicker part of the outer skin is aligned to the same plane as the trailing end surfaces of the cores.

2. A power cord of claim 1, wherein the cores hold leading ends of the cords as directed to be separated from each other, and hold the blades so as to be parallel to each other.

3. A power cord of claim 2, wherein the cores each include a trailing end part and a leading end part, and the trailing end parts of the cores are angled relative to each other as directed to be separated from each other whereas the leading end parts of the cores are parallel to each other.

4. A power cord of claim 1, wherein the outer skin includes a constricted part at a position closer to a leading end of the outer skin than the thicker part, the constricted part being thinner than the thicker part and covering an outer circumferential surface of the cores.

5. A power cord of claim 4, wherein the constricted part is formed to be recessed from the thicker part in a curve in the shape of a portion of a circle or an ellipse.

6. A power cord of claim 1, wherein the outer skin includes a tapering part at a position closer to a trailing end of the outer skin than the thicker part, the tapering part continuously extending from the thicker part and becoming gradually thinner.

7. A power cord of claim 1, wherein the blades each have a wider part in a trailing end part thereof which is wider than a leading end part thereof.

8. A power cord of claim 7, wherein the wider part has a continuous flat surface.

9. A power cord of claim 7, wherein:

the connection section includes a crimping section and a joint section;

the crimping section pressure-contacts the conductors to the trailing end of the blade; and the joint section joints the conductors to the wider part by welding.

10. A power cord of claim 9, wherein the cores each have a thicker part, which is thicker than the remaining part thereof, for covering the wider part of the blade.

11. A power cord of claim 1, wherein:

a single cord among the plurality of cords is provided for each blade; and the plurality of cords are covered together with a common external covering member in the state where a buffering member is interposed between plurality of cords and the common external covering member.

12. A power cord of claim 1, wherein the synthetic resin forming the cores is 66 nylon, and the synthetic resin forming the outer skin is polyvinyl chloride.

13. A power cord, comprising:

a plurality of blades each including an outlet insertion part at a leading end thereof and a connector at a trailing end thereof, the connector being connected to a plurality of conductors exposed from a leading end of a corresponding cord among a plurality of cords;

a plurality of cores each for covering the connector of a single corresponding blade of the plurality of blades, the cores being formed of a synthetic resin; and an outer skin for covering the plurality of cores together such that the plurality of blades are held at a specified interval spacing, so as to form a plug, the outer skin being formed of a synthetic resin; wherein a separate core of the plurality of cores is provided for each blade of the plurality of blades;

the plurality of cores are completely covered by the outer skin;

the blades each have a wider part in a trailing end part thereof, which is wider than a leading end part thereof; and the connection section includes a crimping section and a joint section, the crimping section pressure-contacts the conductors to the trailing end of the blade, and the joint section joints the conductors to the wider part by welding; wherein trailing end surfaces of the cores are aligned to the same plane as each other; and the thicker part of the outer skin is aligned to the same plane as the trailing end surfaces of the cores.

* * * * *